US011247497B2

(12) United States Patent
Yamakawa et al.

(10) Patent No.: US 11,247,497 B2
(45) Date of Patent: Feb. 15, 2022

(54) ATTACHMENT STRUCTURE AND IMAGE FORMING APPARATUS

(71) Applicant: FUJIFILM BUSINESS INNOVATION CORP., Tokyo (JP)

(72) Inventors: Yoichi Yamakawa, Kanagawa (JP); Shumpei Nozawa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/828,433

(22) Filed: Mar. 24, 2020

(65) Prior Publication Data

US 2021/0070073 A1 Mar. 11, 2021

(30) Foreign Application Priority Data

Sep. 11, 2019 (JP) ..... JP2019-165495

(51) Int. Cl.
*B41J 2/00* (2006.01)
*B41J 29/02* (2006.01)

(52) U.S. Cl.
CPC ..... *B41J 29/02* (2013.01)

(58) Field of Classification Search
None
See application file for complete search history.

(56) References Cited

U.S. PATENT DOCUMENTS 10,099,891 B2 10/2018 Mizuguchi
2017/0346968 A1* 11/2017 Li ..... B41J 3/46

FOREIGN PATENT DOCUMENTS

| | | | |
|---|---|---|---|
| JP | 2007-50972 A | | 3/2007 |
| JP | 2007050972 A | * | 3/2007 |
| JP | 2016-109781 A | | 6/2016 |
| JP | 2016-133615 A | | 7/2016 |

* cited by examiner

*Primary Examiner* — Erica S Lin
*Assistant Examiner* — Tracey M McMillion
(74) *Attorney, Agent, or Firm* — Oliff PLC

(57) ABSTRACT

An attachment structure includes: a shaft part via which a plate-like member is supported on a body in a manner capable of being opened and closed; a torsion spring to be fitted on the shaft part exposed in an open state, the torsion spring generating a damping force when the plate-like member is brought to the open state; a temporarily fixing groove extending along the shaft part and into which a one-end portion of the torsion spring fitted on the shaft part is inserted to temporarily fix the torsion spring to the body; and a bracket that is fixed to the body in the open state and presses the one-end portion of the torsion spring. The plate-like member has a gap in which, in a closed state, the torsion spring can be moved along the shaft part so that another-end portion of the torsion spring is inserted into an insertion hole in the plate-like member.

20 Claims, 16 Drawing Sheets

ATTACHMENT STRUCTURE AND IMAGE FORMING APPARATUS

CROSS-REFERENCE TO RELATED APPLICATIONS

This application is based on and claims priority under 35 USC 119 from Japanese Patent Application No. 2019-165495 filed Sep. 11, 2019.

BACKGROUND

(i) Technical Field

The present disclosure relates to an attachment structure and an image forming apparatus.

(ii) Related Art

Japanese Unexamined Patent Application Publication No. 2007-050972 discloses a manual paper-feed device. A tray of this manual paper-feed device is rotatably supported on a unit case via first and second arms. When the tray is closed, the bottom surface of the tray is flush with the exterior surface of a body. A torsion coil spring is fitted on a shaft of the first arm to serve as a damper when the tray is opened. The shaft is located so as not to interfere with a sheet transport path extending from a sheet insertion port, and the torsion coil spring can be disposed inside the unit case.

Japanese Unexamined Patent Application Publication No. 2016-133615 discloses an image forming apparatus. A manual tray is supported on an image-forming body such that it can be opened and closed. In the image forming apparatus, a power spring provided on the image-forming body urges the manual tray against the weight thereof or the like via a wire attached at one end thereof to the manual tray to reduce an impact caused when the manual tray is opened.

Japanese Unexamined Patent Application Publication No. 2016-109781 discloses a sheet loading device. A third discharge tray is provided on an open/close door, which is opened or closed with respect to a body, and a stopper for the third discharge tray and a damper unit that resists when the open/close door is opened and closed are provided. The damper unit reduces the opening speed of the open/close door.

SUMMARY

Aspects of non-limiting embodiments of the present disclosure relate to providing an attachment structure and image forming apparatus in which ease of fitting is improved, compared with a configuration in which a torsion spring is attached to a plate-like member, which is opened and closed with respect to a body, when the plate-like member is in an open state.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an attachment structure including: a shaft part via which a plate-like member is supported on a body in a manner capable of being opened and closed; a torsion spring to be fitted on the shaft part exposed in an open state, the torsion spring generating a damping force when the plate-like member is brought to the open state; a temporarily fixing groove extending along the shaft part and into which a one-end portion of the torsion spring fitted on the shaft part is inserted to temporarily fix the torsion spring to the body; and a bracket that is fixed to the body in the open state and presses the one-end portion of the torsion spring. The plate-like member has a gap in which, in a closed state, the torsion spring can be moved along the shaft part so that another-end portion of the torsion spring is inserted into an insertion hole in the plate-like member.

BRIEF DESCRIPTION OF THE DRAWINGS

Exemplary embodiment of the present disclosure will be described in detail based on the following figures, wherein.

DETAILED DESCRIPTION

First Exemplary Embodiment

Figure 1:
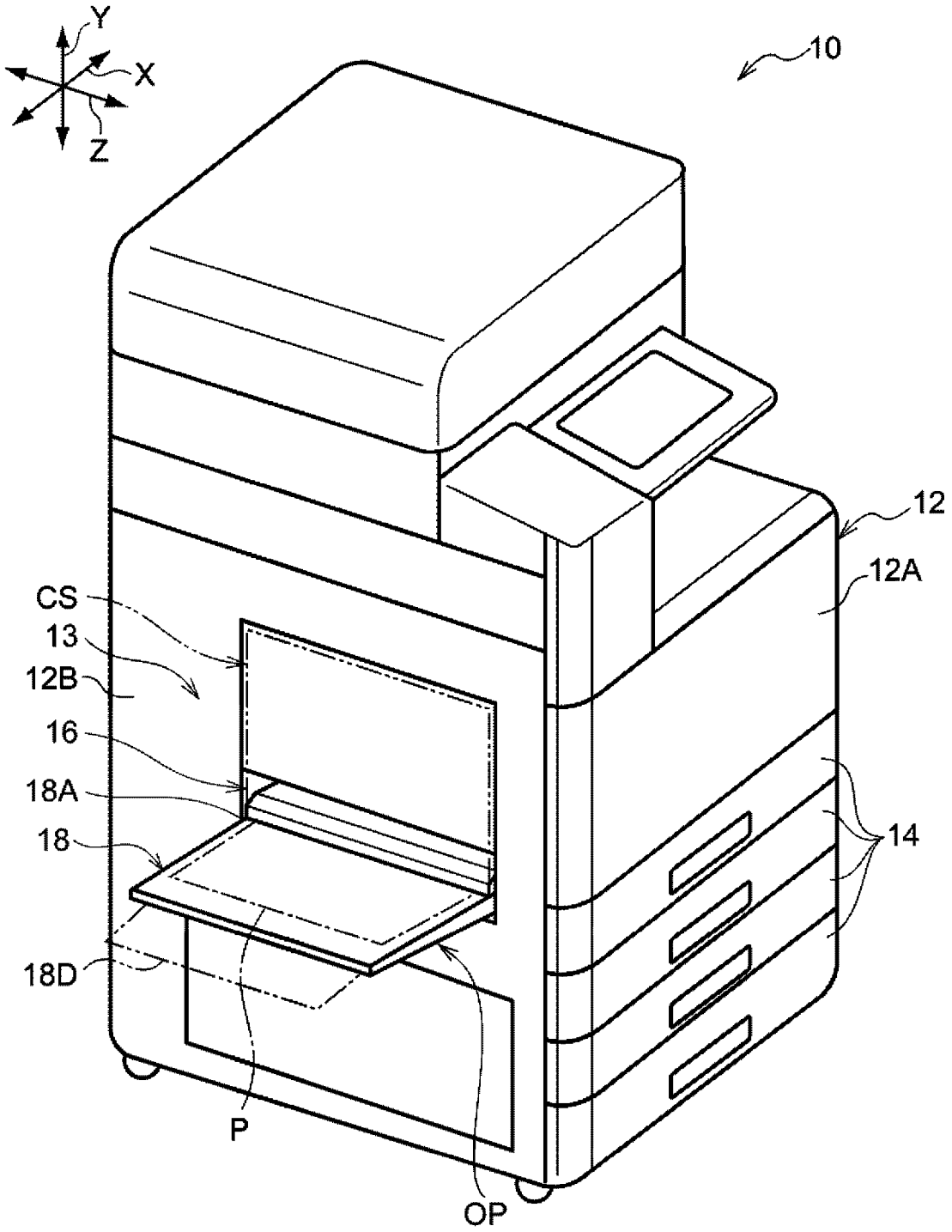
FIG. 1 is a perspective view of an image forming apparatus having an attachment structure according to a first exemplary embodiment.

Now, a first exemplary embodiment will be described with reference to the drawings. In the description below, the directions indicated by arrows X and Y in the drawings will be referred to as the width and height directions, respectively. The depth direction, which is perpendicular to the width and height directions, is indicated by arrow Z.

FIG. 1 is a perspective view of an image forming apparatus 10 having an attachment structure according to this exemplary embodiment. The image forming apparatus 10 forms an image on a medium P. A body 12 of the image forming apparatus 10 includes an image forming part (not shown) that forms an image on the medium P, and a transport part (not shown) that transports the medium P to the image forming part.

The medium P may also be referred to as a sheet or a film on which an image is formed. The medium P includes a sheet of paper or an OHP sheet of polyethylene terephthalate (PET) resin.

The medium P on which an image is to be formed is supplied from a sheet storage part 14 accommodated in a front side 12A of the body 12 such that it can be pulled out. Alternatively, the medium P can be supplied from a manual tray part 13 provided on a side surface of the body 12.

A sheet supply port 16, through which a medium P is supplied, is provided in a side surface 12B of the body 12. A base end portion 18A of a plate-like member 18 is supported at the lower part of the sheet supply port 16. The plate-like member 18 can be either in a closed state CS, in which it is extends along the side surface 12B, and an open state OP, in which it projects sideward from the side surface 12B and is inclined such that the distal end thereof is higher than the base end portion.

Plate-Like Member

Figure 2:
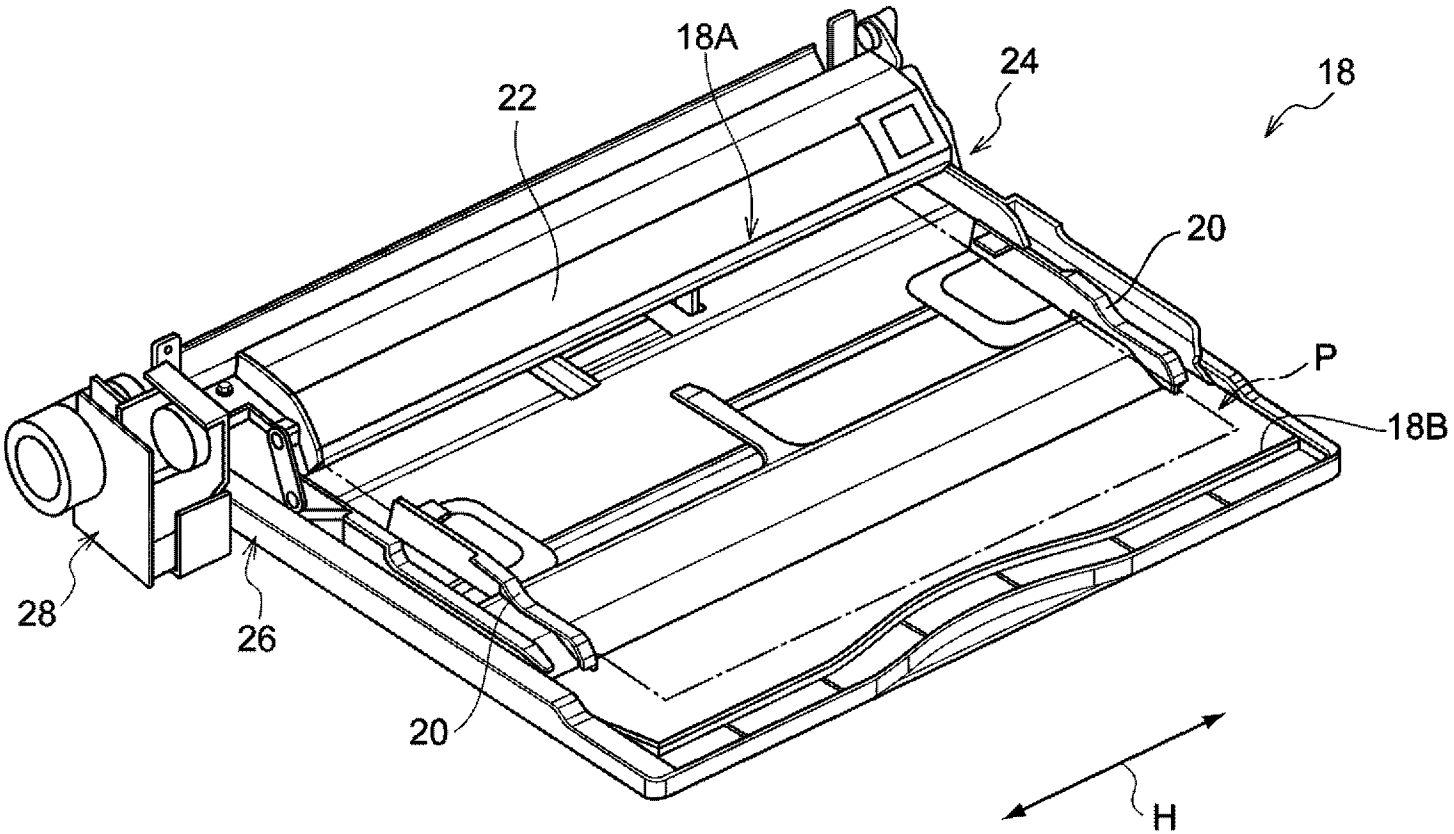
FIG. 2 is a perspective view of a plate-like member according to the first exemplary embodiment.

The plate-like member 18 is made of a synthetic resin. As shown in FIG. 2, the plate-like member 18 has a size sufficient to support the medium P. A pair of width guides 20 that guide the side edges of the medium P placed on the plate-like member 18 are provided on a top surface 18B so as to be slidable in the width direction H.

The plate-like member 18 constitutes a tray used to supply a medium P on which an image is to be formed. The plate-like member 18 may also be referred to as a tray or a manual tray used to supply a desired medium P.

The base end portion 18A of the plate-like member 18 is covered with a cover 22. An attachment structure (described below) is provided below the cover 22, on a one side portion 24 side of the plate-like member 18. A mechanism 28 for transporting the medium P into the body 12 is provided on another side portion 26 side of the plate-like member 18. When the mechanism 28 is actuated, a medium P on the plate-like member 18 is supplied into the body 12 through the sheet supply port 16, and an image is formed on the medium P.

The plate-like member 18 has an extension tray 18D. In a state in which the extension tray 18D is stored in the back of the plate-like member 18, a gap 102 (described below) is closed.

Figure 3:
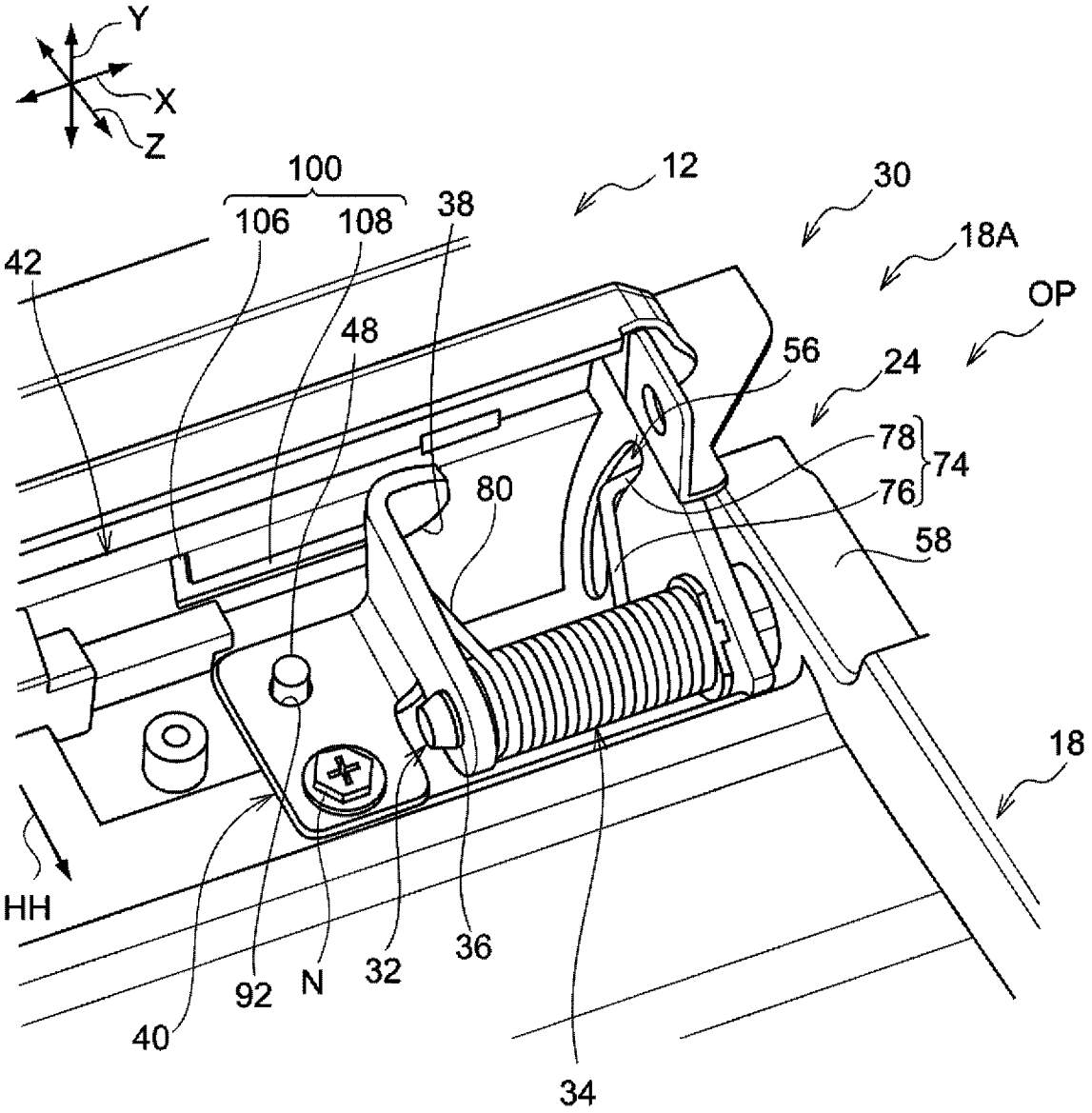
FIG. 3 is a perspective view of the attachment structure according to the first exemplary embodiment.
Figure 20:
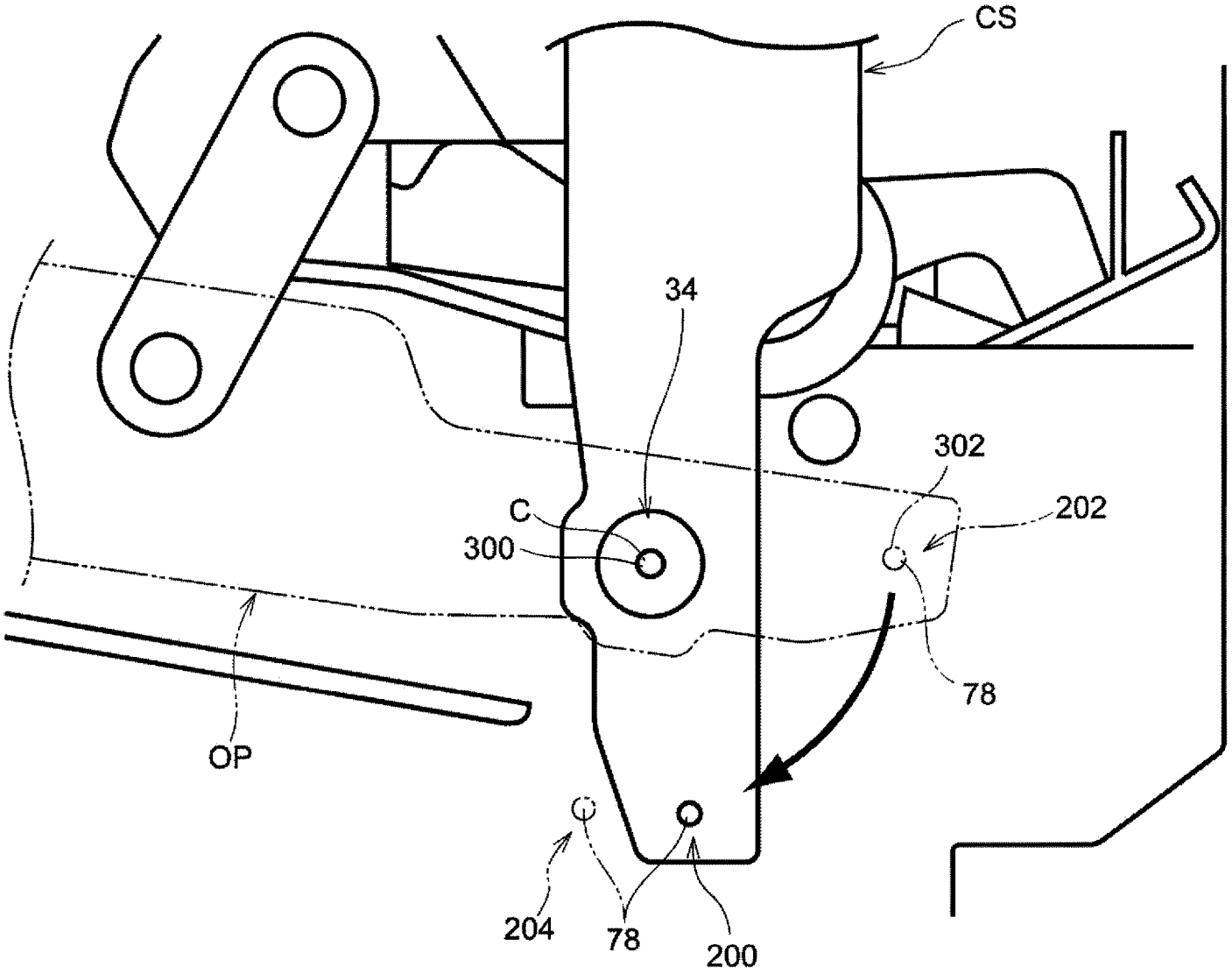
FIG. 20 is an explanatory diagram of the relevant part, showing an opening/closing operation of the plate-like member according to the first exemplary embodiment.

As shown in FIGS. 3 and 20, arm portions 58 are provided on both sides of the base end portion 18A of the plate-like member 18. The arm portions 58 each have a support hole 300 that receives a shaft part 32 (described below) and a spring hole 302 (described below) that receives a one-side extending portion 78, which constitutes a one-end portion 74 of the torsion spring 34.

Attachment Part

FIG. 3 is a perspective view showing the structure of an attachment part 30 via which the plate-like member 18 is attached to the body 12. FIG. 3 shows the one side portion 24 side of the plate-like member 18 without the cover 22 and in the open state OP.

The attachment part 30 includes a shaft part 32 via which the plate-like member 18 is supported on the body 12 in a manner capable of being opened or closed, and a torsion spring 34 that is fitted on the shaft part 32 exposed in the open state OP and generates a damping force when the plate-like member 18 is brought to the closed state CS. The attachment part 30 also has a temporarily fixing groove 100 extending in the shaft part 32 and into which a one-end portion 80 of the torsion spring 34 fitted on the shaft part 32 is inserted to temporarily fix the torsion spring 34 to the body 12.

Figure 12:
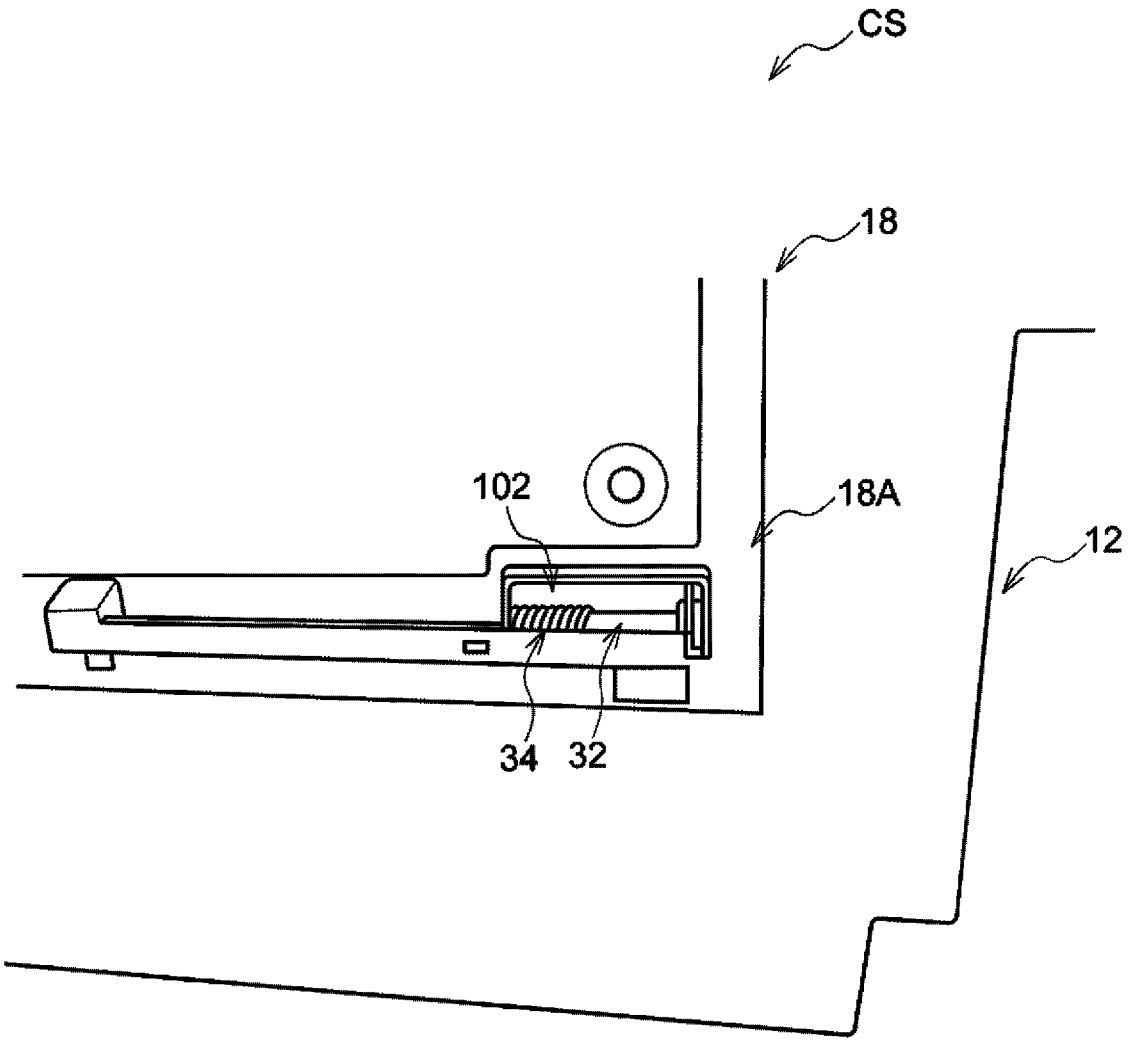
FIG. 12 is a side view showing the attachment process following FIG. 11.
Figure 15:
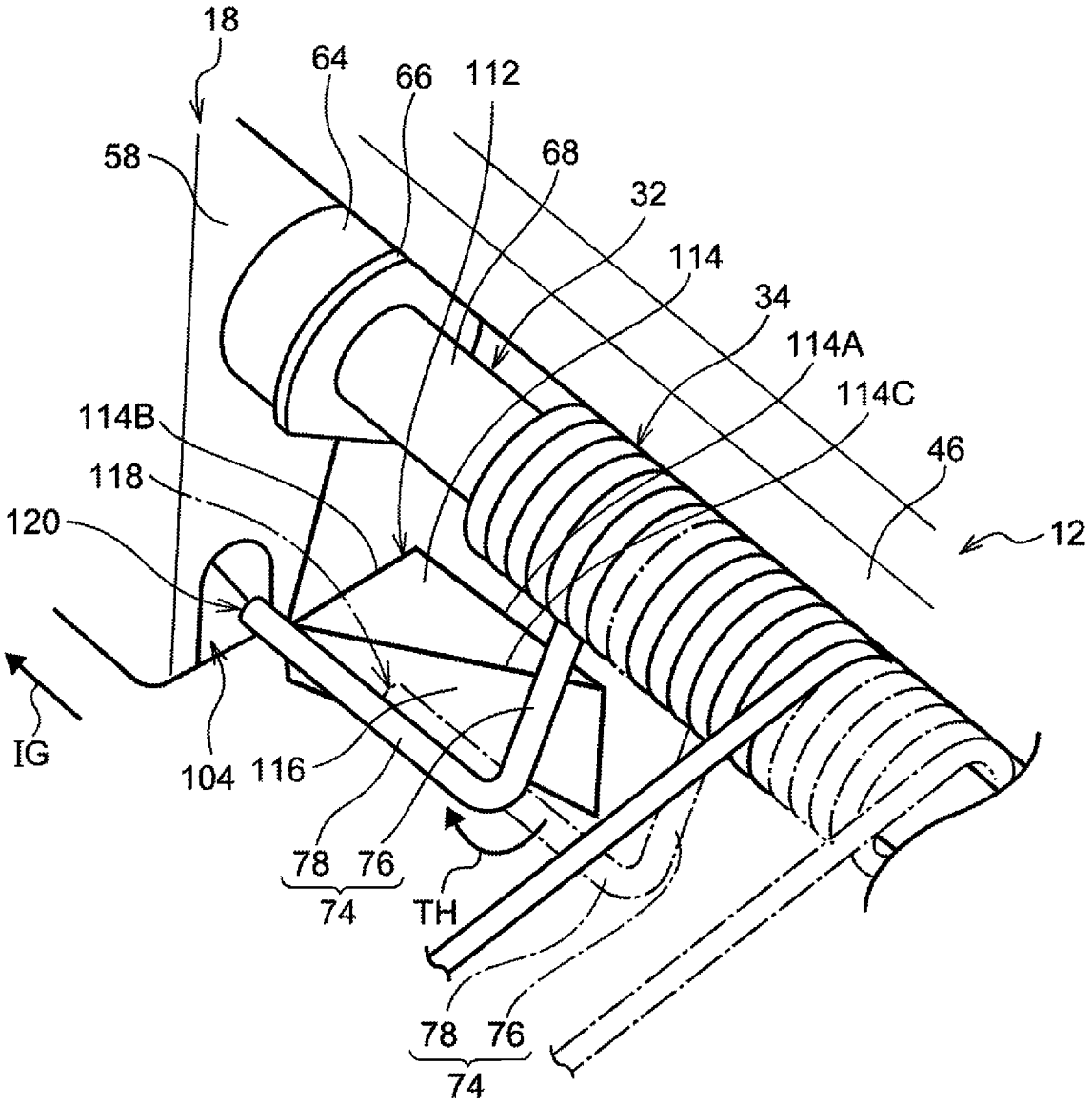
FIG. 15 is an enlarged view of the relevant part in FIG. 14.

Furthermore, as shown in FIG. 12, the base end portion 18A of the plate-like member 18 has a gap 102, in which, in the closed state CS, the torsion spring 34 is moved along the shaft part 32, and the other-end portion 74 of the torsion spring 34 is inserted into an insertion hole 104 in the plate-like member 18, as shown in FIG. 15. For ease of explanation, FIG. 15 shows the torsion spring 34 as viewed from the body 12 side, and an upright wall 52 of the frame component 42 is illustrated as a transparent member.

As shown in FIG. 3, the attachment part 30 includes a bracket 40 fixed to the body 12 in the open state OP and having a bearing portion 36 that supports the shaft part 32 and a reaction-force receiving portion 38 that presses the one-end portion 80 of the torsion spring 34 and receives the reaction force therefrom.

Frame Component

Figure 4:
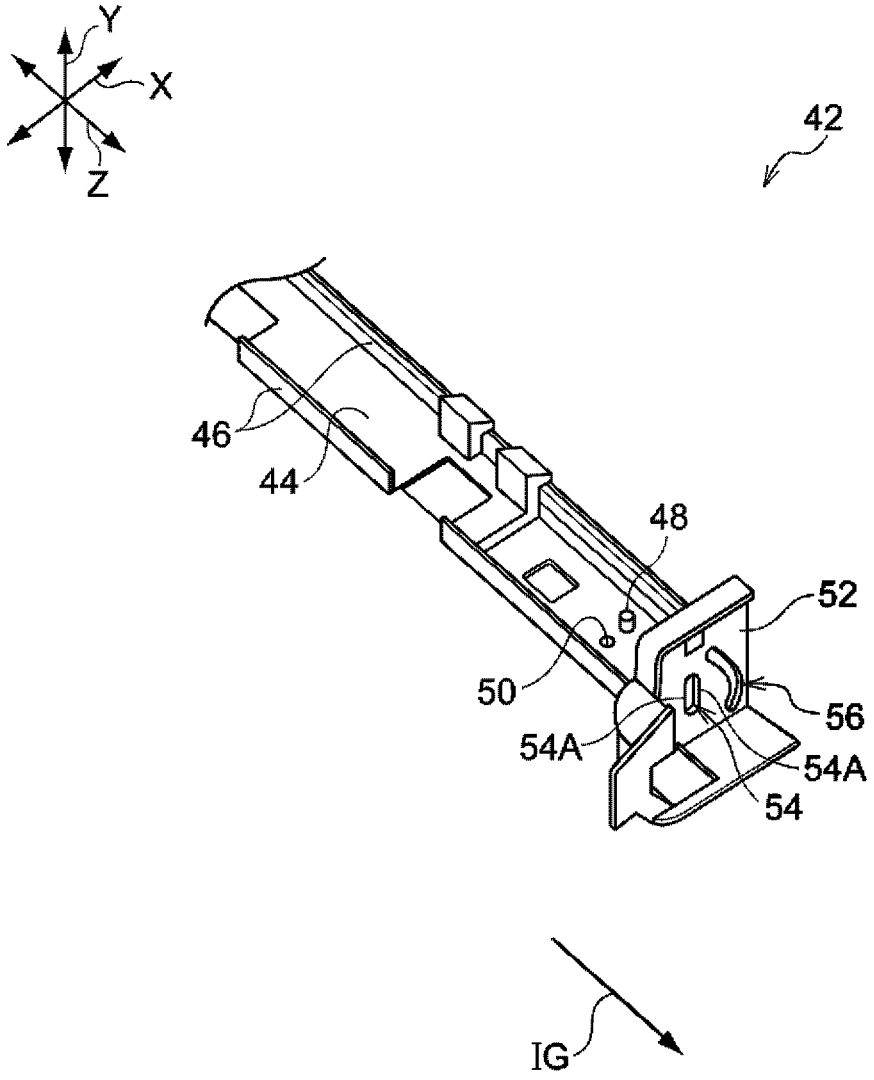
FIG. 4 is a perspective view showing the relevant part of a frame constituting member according to the first exemplary embodiment.

The frame component 42 is formed of a synthetic resin. As shown in FIGS. 3 and 4, the frame component 42 includes a long, plate-like base 44 fixed to the body 12 so as to extend in the depth direction Z of the body 12, and reinforcement flanges 46 formed on the edges of the base 44 extending in the longitudinal direction.

The base 44 has, at one end thereof, a circular screw hole 50 and a cylindrical positioning portion 48 for positioning the bracket 40. The upright wall 52 is provided on one end side IG of the positioning portion 48 and the screw hole 50.

Although the positioning portion 48 according to this exemplary embodiment is cylindrical, the shape of the positioning portion 48 is not limited thereto. The positioning portion 48 may have a shape surrounding the bracket 40 to position the bracket 40.

The upright wall 52 has a bearing 54 that receives the shaft part 32. The bearing 54 has an elliptical shape with linear portions 54A, which are linear edges extending along the longitudinal axis.

The upright wall 52 also has an arc-shaped hole 56 centered at the bearing 54. The arc-shaped hole 56 is located closer to the body 12 than the bearing 54 is, when the frame component 42 is fixed to the body 12.

As shown in FIG. 3, the reinforcement flange 46 that is closer to the body 12 when the frame component 42 is fixed to the body 12 has the above-described temporarily fixing groove 100. The temporarily fixing groove 100 has an L shape including a longitudinal groove 106, which receives the one-end portion 80 extending sideward from the torsion spring 34, and a lateral groove 108 extending along the shaft part 32 from the lower end of the longitudinal groove 106.

Figure 5:
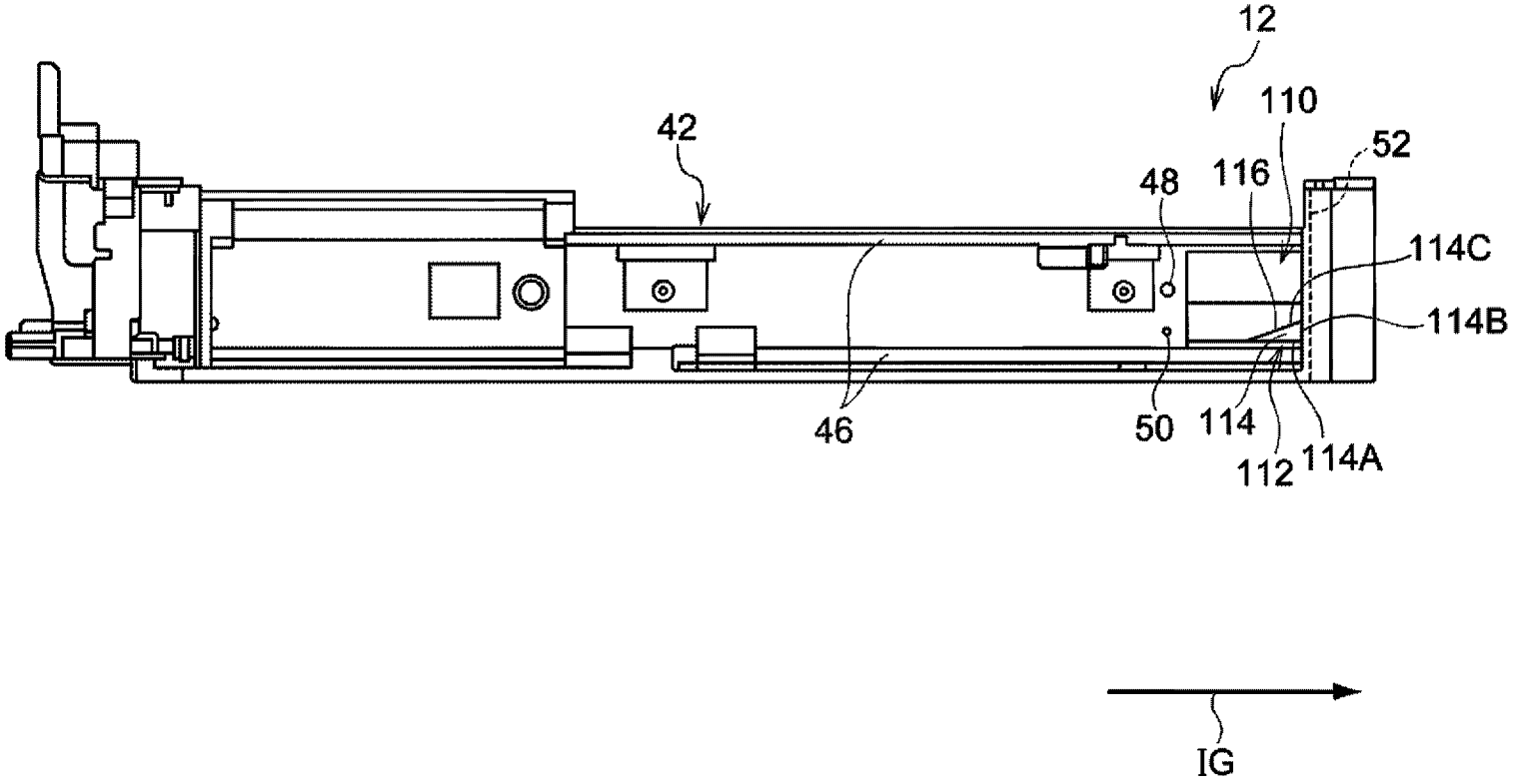
FIG. 5 is a plan view of a frame constituting member according to the first exemplary embodiment.

As shown in FIG. 5, a rectangular recess 110 extending in the longitudinal direction of the base is formed between the upright wall 52 and the position where the positioning portion 48 and the screw hole 50 are provided. As shown in FIGS. 5 and 15, a guide portion 112 for guiding the other-end portion 74 of the torsion spring 34, which is moved along the shaft part 32 when fitted thereon, into the insertion hole 104 provided in the arm portion 58 extending from the end of the plate-like member 18 is formed on the bottom of the recess 110.

The guide portion 112 has a triangular column shape, and a top surface 114 of the guide portion 112 has the shape of a right-angled triangle.

A first side 114A of the top surface 114 extends along the reinforcement flange 46 of the frame component 42 farther from the body 12, in a state in which the frame component 42 is attached to the body 12. A second side 114B of the top surface 114 extends along the upright wall 52 and extends from the first side 114A toward the body 12.

A third side 114C of the top surface 114 is inclined toward the body 12, from the center of the frame component 42 in the longitudinal direction thereof toward the one end IG. The point of intersection of the second side 114B and the third side 114C is located near the insertion hole 104 in the plate-like member 18, the insertion hole 104 being located on the far side of the arc-shaped hole 56.

A side surface extending downward from the third side 114C of the guide portion 112 constitutes an inclined surface 116 that guides the other-end portion 74 of the torsion spring 34 toward the insertion hole 104 in the plate-like member 18. The inclined surface 116 is provided between an initial position 118, where the other-end portion 74 is located when the torsion spring 34 is fitted on the shaft part 32 of the attachment part 30, and an insertion position 120, where the other-end portion 74 is inserted into the insertion hole 104. In other words, the inclined surface 116 is located between the initial position 118 and the insertion position 120.

The inclined surface 116 moves the other-end portion 74 of the torsion spring 34 in a direction TH, in which the spring force of the torsion spring 34, supported at the one-end portion 80 thereof in the temporarily fixing groove 100, increases as the other-end portion 74 is guided from the initial position 118 to the insertion position 120. In other words, the inclined surface 116 rotates the other-end portion 74 in the direction TH, in which the spring force of the torsion spring 34 increases, as the inclined surface 116 guides the other-end portion 74 from the initial position 118 to the insertion position 120.

Shaft Part

Figure 6:
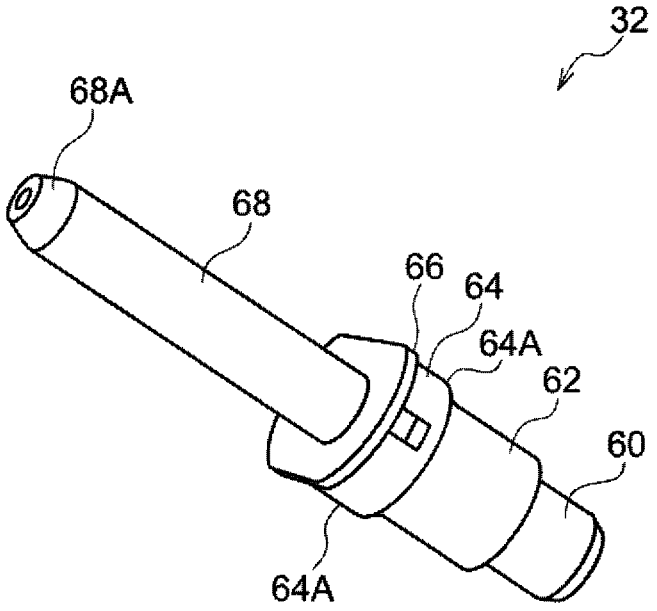
FIG. 6 is a perspective view of a shaft part according to the first exemplary embodiment.

The shaft part 32 is formed of a synthetic resin. As shown in FIGS. 3 and 6, the shaft part 32 has, at one end thereof, a cylindrical insertion portion 60 to be rotatably inserted into the arm portion 58 of the plate-like member 18. A cylindrical large-diameter portion 62 having a larger diameter than the insertion portion 60 is formed at the other end of the insertion portion 60.

A rotation stopper 64 having a larger diameter than the large-diameter portion 62 is formed at the other end of the large-diameter portion 62. The rotation stopper 64 has an elliptical shape so as to be inserted into the bearing 54 in the frame component 42, and the rotation stopper 64 has planar portions 64A that come into contact with the linear portions 54A of the bearing 54.

A shaft flange 66 projecting outward is provided at the other end of the rotation stopper 64. The shaft flange 66 restricts the movement of the shaft part 32 toward the bearing 54 in the insertion direction. A cylindrical fitting shaft 68, on which the torsion spring 34 is fitted, is formed at the other end of the shaft flange 66. The fitting shaft 68 has a chamfered portion 68A at the end so that the torsion spring 34 can be easily fitted.

Torsion Spring

Figure 7:
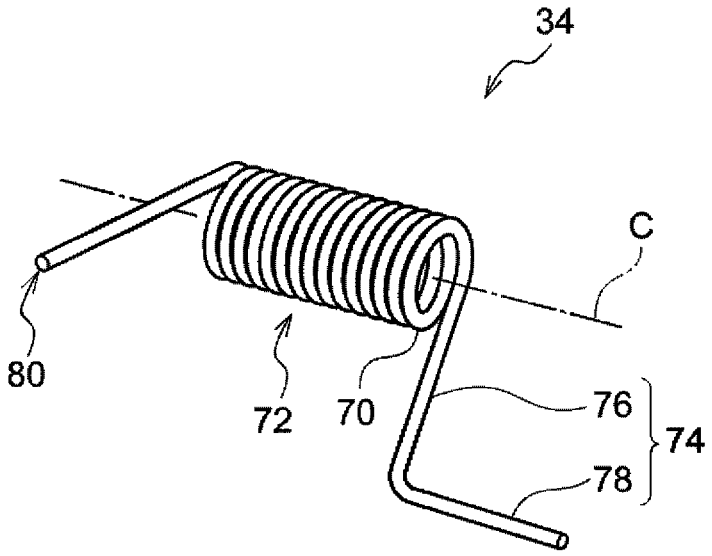
FIG. 7 is a perspective view of a torsion spring according to the first exemplary embodiment.
Figure 8:
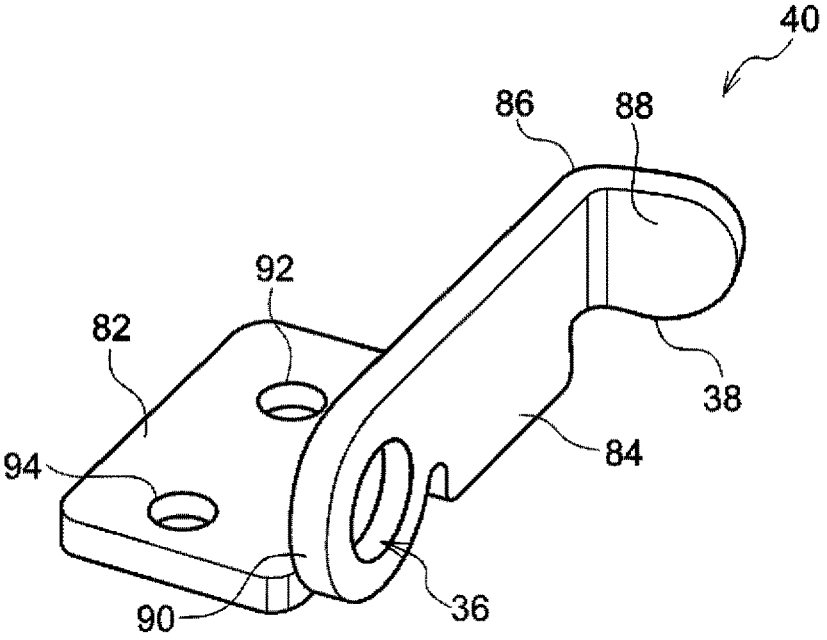
FIG. 8 is a perspective view of a bracket according to the first exemplary embodiment.

As shown in FIGS. 3 and 7, the torsion spring 34 has a coil portion 72, in which a steel wire 70 is spirally wound.

The one-end portion 80 of the steel wire 70 extends linearly sideward from the coil portion 72 from one end of the coil portion 72.

The other-end portion 74 of the steel wire 70 extends from the other end of the coil portion 72. The other-end portion 74 includes a sideward-extending portion 76 extending linearly sideward from the coil portion 72 and another-side extending portion 78 extending linearly toward the other side from the sideward-extending portion 76. The other-side extending portion 78 passes through the arc-shaped hole 56 in the frame component 42 and is inserted into an insertion hole in the arm portion 58 of the plate-like member 18 (see FIG. 3).

The torsion spring 34 may also be referred to as a coil spring or a torsion coil spring, which is an example of the coil spring, that generates a spring force when the other-end portion 74 or the one-end portion 80 is twisted about the central axis C of the coil portion 72. The spring force generated in the torsion spring 34 is the damping force mentioned above.

Bracket

As shown in FIGS. 3 and 7, the bracket 40 is formed by bending a metal plate.

The bracket 40 has a rectangular fixing portion 82 fixed to the body 12 via the frame component 42, and a rectangular upright portion 84 standing upright from a long side of the fixing portion 82 and constituting the bearing portion 36. The bracket 40 also has a side-edge extending portion 88 extending from one side edge 86 of the upright portion 84 in the longitudinal direction, toward the side opposite from the fixing portion 82 in the thickness direction of the upright portion 84. The side-edge extending portion 88 constitutes the reaction-force receiving portion 38.

The upright portion 84 has, on another side edge 90 side, a circular hole constituting the bearing portion 36. The bearing portion 36 receives and supports the fitting shaft 68 of the shaft part 32. The side-edge extending portion 88 extends from the one side edge 86, which is opposite from the other side edge 90 having the bearing portion 36.

The fixing portion 82 has two fixing holes: a positioning hole 92 that receives the positioning portion 48 provided on the frame component 42 fixed to the body 12 in an attached state, and a screw hole 94 that receives a fixing screw N. The screw hole 94 is located farther from the body 12 than the positioning hole 92 is, in a direction HH.

Attachment Process

When the plate-like member 18 is attached to the body 12, the frame component 42 is fixed to the body 12. The shaft part 32 is inserted into the bearing 54 in the frame component 42, the rotation stopper 64 is inserted into the bearing 54, and the insertion portion 60 is inserted into the arm portion 58 of the plate-like member 18. Thus, the plate-like member 18 is supported on the body 12 in a manner capable of being opened or closed (see FIG. 3).

Figure 9:
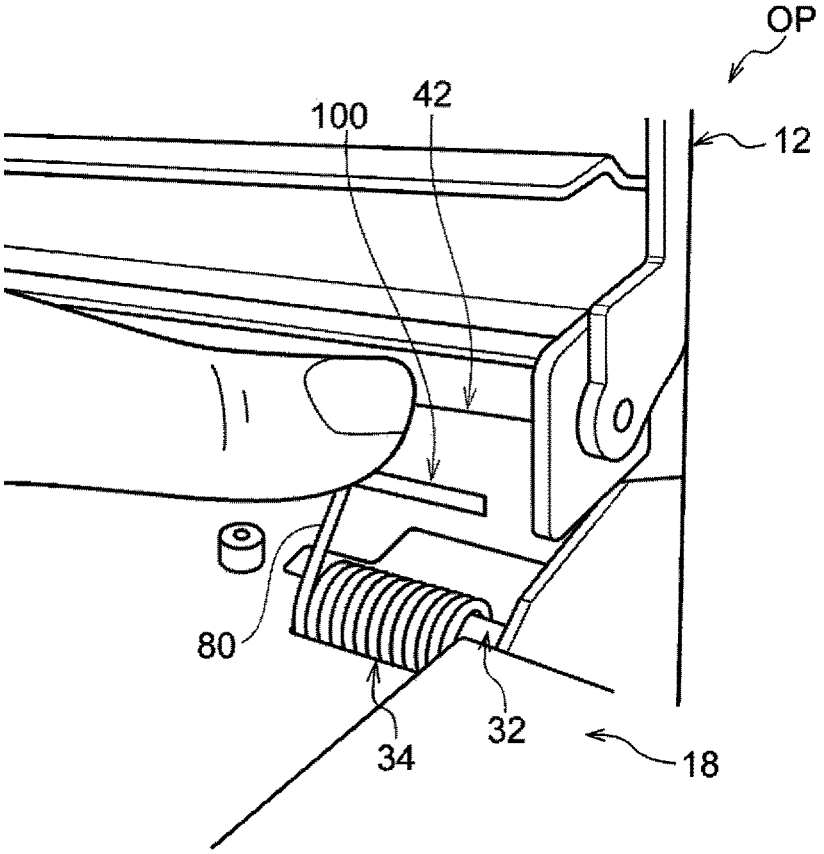
FIG. 9 is a perspective view showing an attachment process for attaching the plate-like member to a body, according to the first exemplary embodiment.
Figure 10:
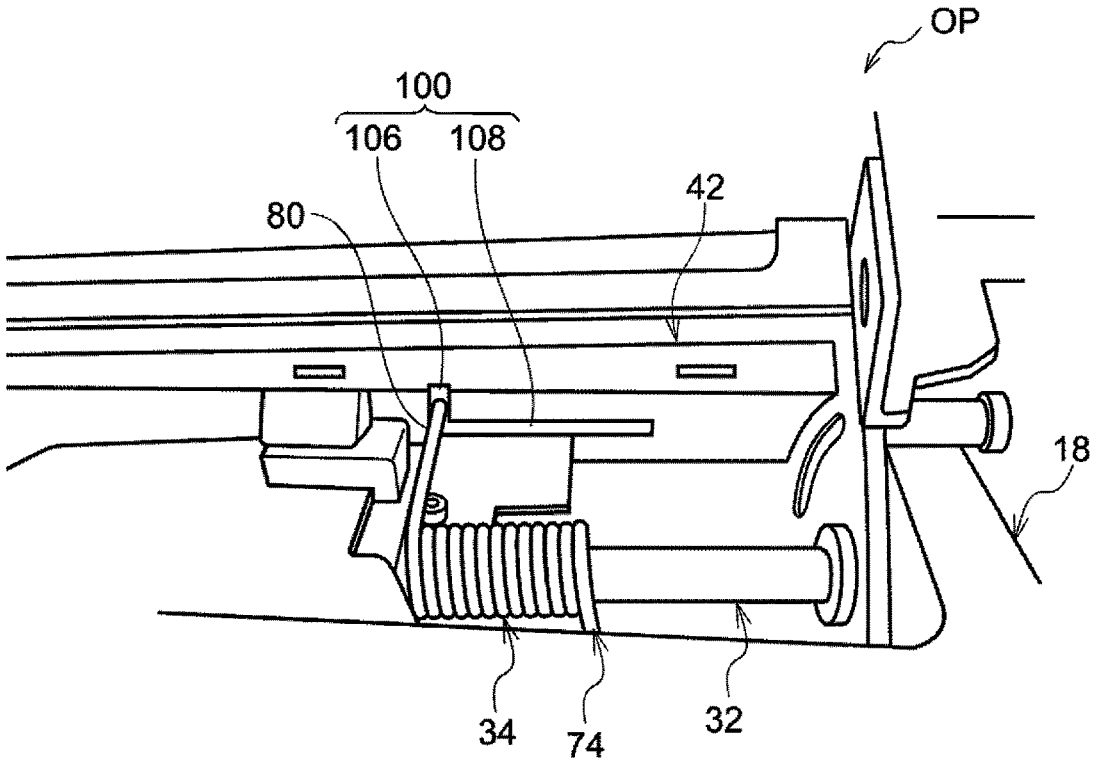
FIG. 10 is a perspective view showing the attachment process following FIG. 9.

Then, while the plate-like member 18 is maintained in the open state OP, the torsion spring 34 is fitted on the shaft part 32 from the other end side. Then, the one-end portion 80 of the torsion spring 34 is pushed with a finger, as shown in FIG. 9, to insert the one-end portion 80 of the torsion spring 34 into the longitudinal groove 106 of the temporarily fixing groove 100 in the frame component 42, as shown in FIG. 10.

Figure 11:
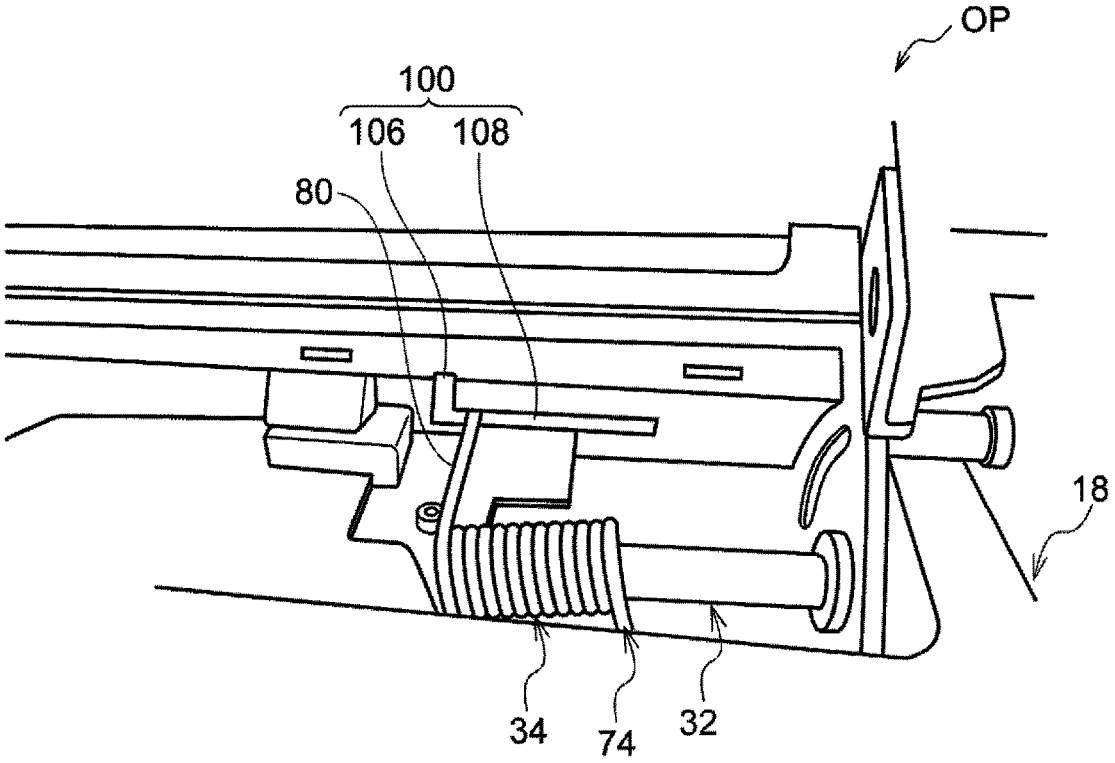
FIG. 11 is a perspective view showing the attachment process following FIG. 10.

In this state, as shown in FIG. 11, the one-end portion 80 of the torsion spring 34 is moved to the lateral groove 108 of the temporarily fixing groove 100 and is temporarily fixed.

At this time, the other-end portion 74 of the torsion spring 34 comes into contact with the reinforcement flange 46 of the frame component 42 farther from the body 12, whereby the rotation of the torsion spring 34 is inhibited. The one-end portion 80 of the torsion spring 34 is temporarily fixed in the lateral groove 108 of the temporarily fixing groove 100 in a state in which it has been rotated in the winding direction of the coil portion 72. Thus, the spring force is generated in the torsion spring 34.

In this state, if the plate-like member 18 is brought to the closed state CS, as shown in FIG. 12, the other-end portion 74 of the torsion spring 34 in contact with the reinforcement flange 46 of the frame component 42 rotates in the direction opposite to the winding direction of the coil portion 72, lowering the spring force of the torsion spring 34. The torsion spring 34 fitted on the shaft part 32 is exposed from the gap 102 in the plate-like member 18.

Figure 13:
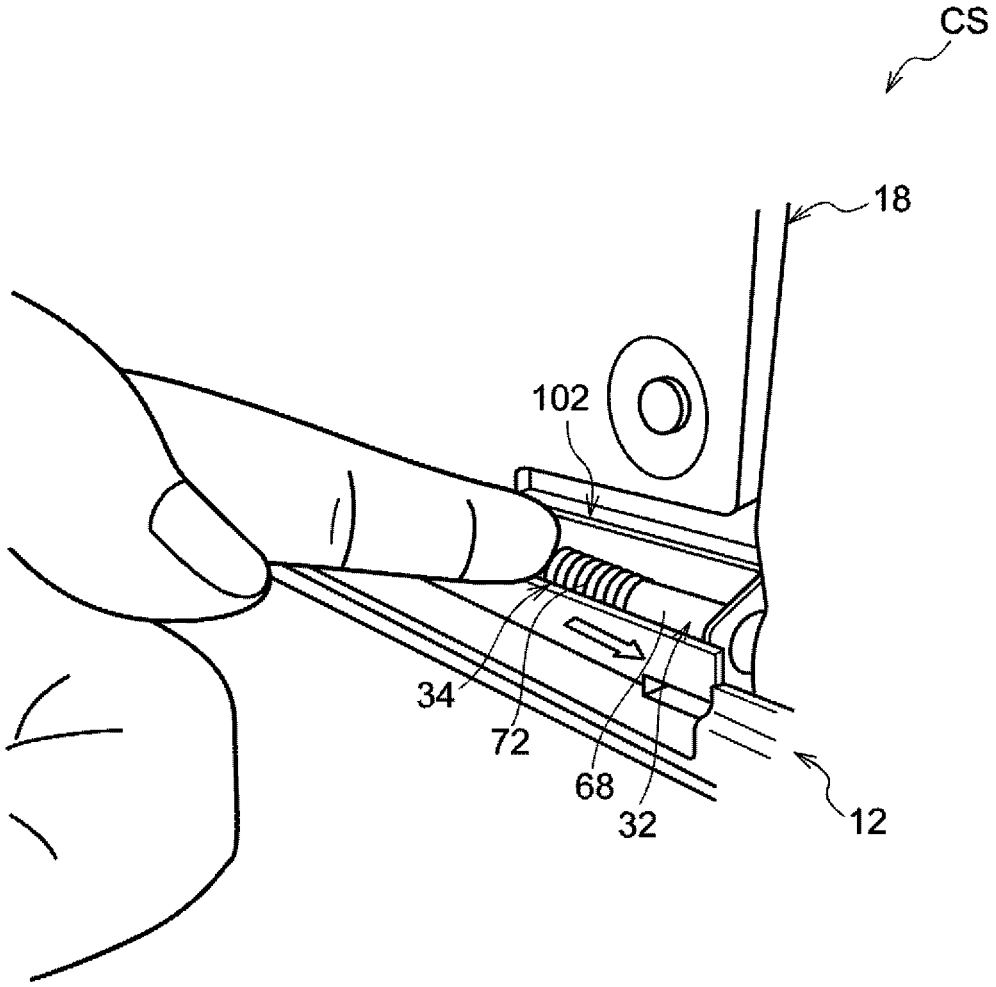
FIG. 13 is a perspective view showing the attachment process following FIG. 12.
Figure 14:
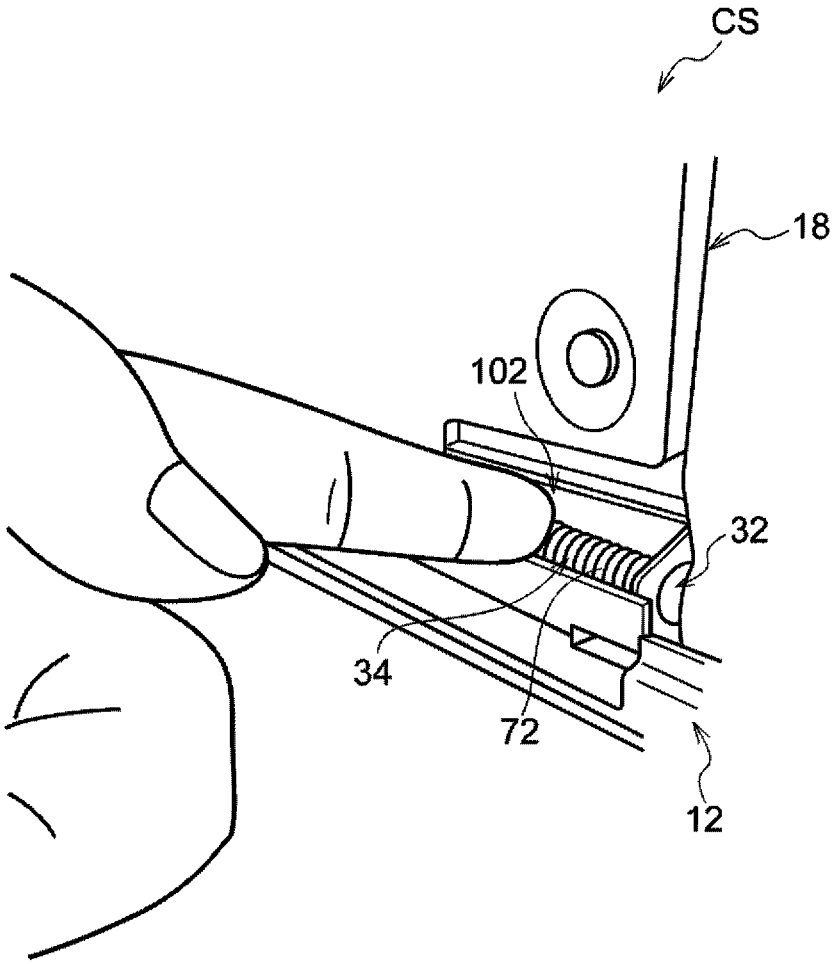
FIG. 14 is a perspective view showing the attachment process following FIG. 13.

In this state, as shown in FIG. 13, with a finger inserted into the gap 102, the coil portion 72 of the torsion spring 34 is pushed and moved along the shaft part 32, as shown in FIG. 14.

As shown in FIG. 15, the frame component 42 has the guide portion 112 that guides the other-end portion 74 of the torsion spring 34, which is moved along the shaft part 32, to the insertion hole 104. As a result of the movement above, the other-end portion 74 of the torsion spring 34 is guided by the guide portion 112, passes through the arc-shaped hole 56 in the frame component 42, and is inserted into the insertion hole 104 provided in the arm portion 58 of the plate-like member 18.

The guide portion 112 has the inclined surface 116, which moves the other-end portion 74 in the direction TH, in which the spring force of the torsion spring 34 increases as the other-end portion 74 is guided from the initial position 118, where the other-end portion 74 is located before the torsion spring 34 is moved along the shaft part 32, to the insertion position 120. Hence, the other-end portion 74 of the torsion spring 34 is inserted into the insertion hole 104 in the plate-like member 18 through the arc-shaped hole 56 in the frame component 42, in a state in which the spring force thereof has been increased. Thus, rattling of the torsion spring 34 is suppressed.

Figure 16:
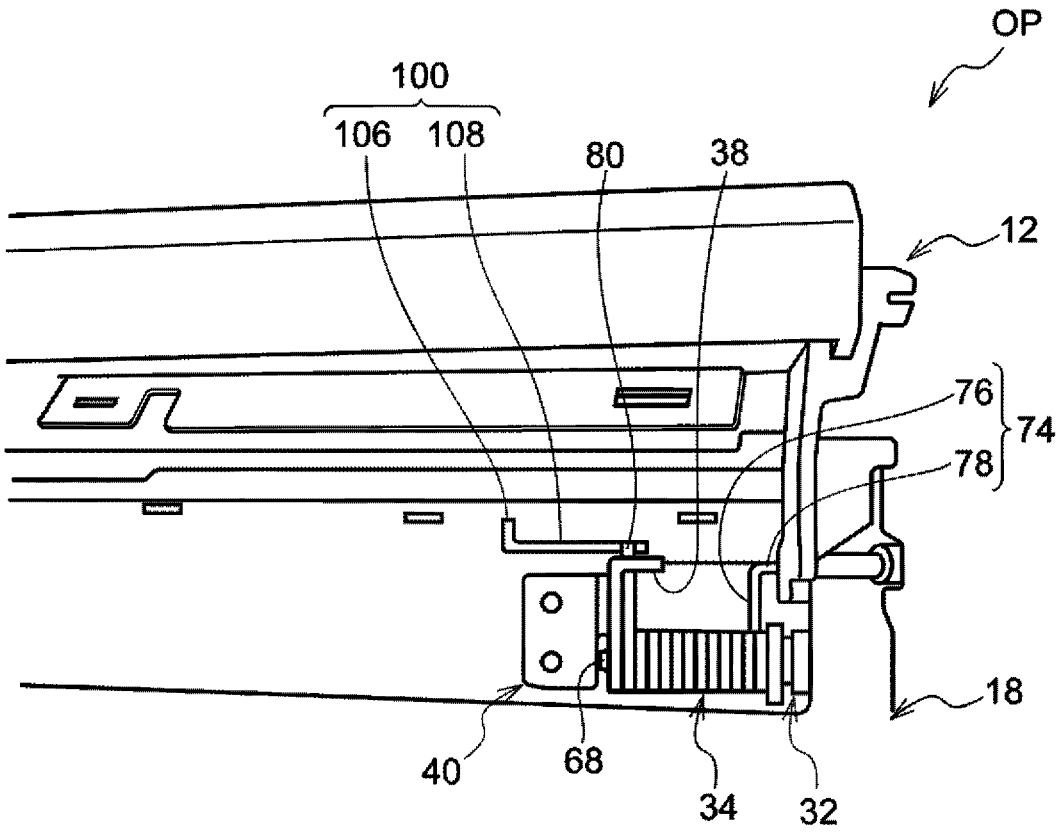
FIG. 16 is a plan view showing the attachment process following FIG. 15.

Next, as shown in FIG. 16, the plate-like member 18 is brought to the open state OP, and the fitting shaft 68 of the shaft part 32 is inserted into the bearing portion 36 in the bracket 40 to temporarily fix the bracket 40 to the shaft part 32.

Figure 17:
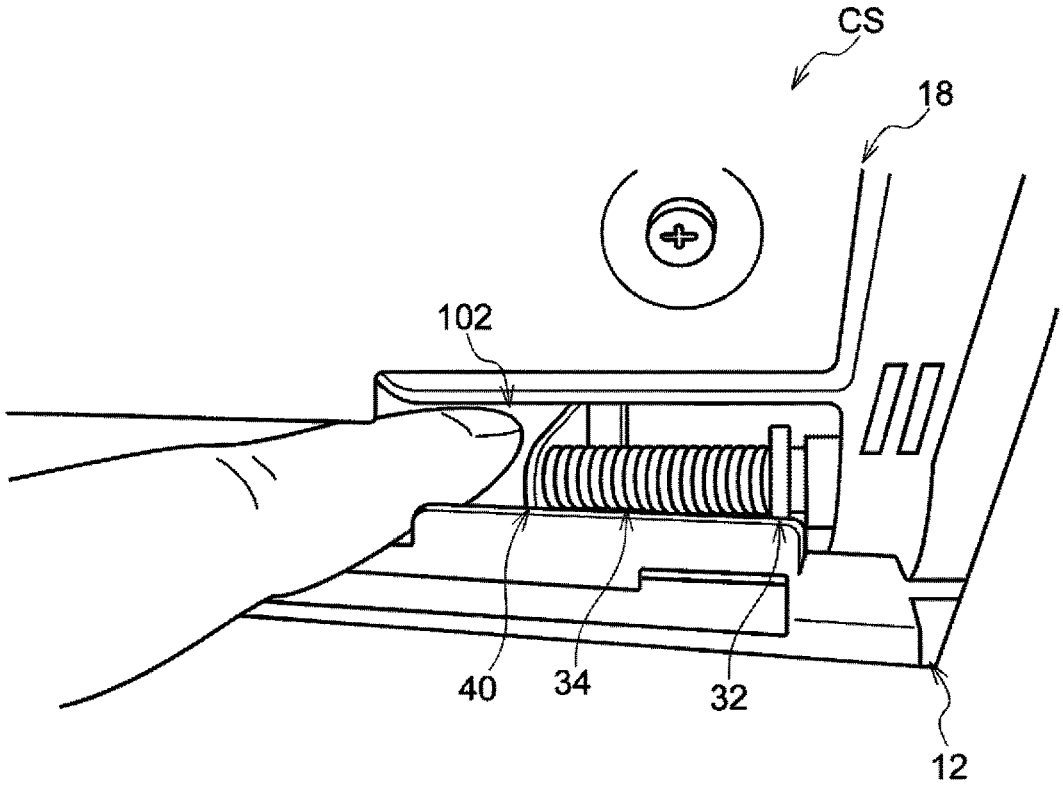
FIG. 17 is a side view showing the attachment process following FIG. 16.

In this state, as shown in FIG. 17, the plate-like member 18 is brought to the closed state CS, so that the bracket 40 is exposed from the gap 102 in the plate-like member 18. Then, the positioning portion 48 of the frame component 42 is inserted into the positioning hole 92 in the bracket 40 with the finger inserted into the gap 102 to position the bracket 40.

Figure 18:
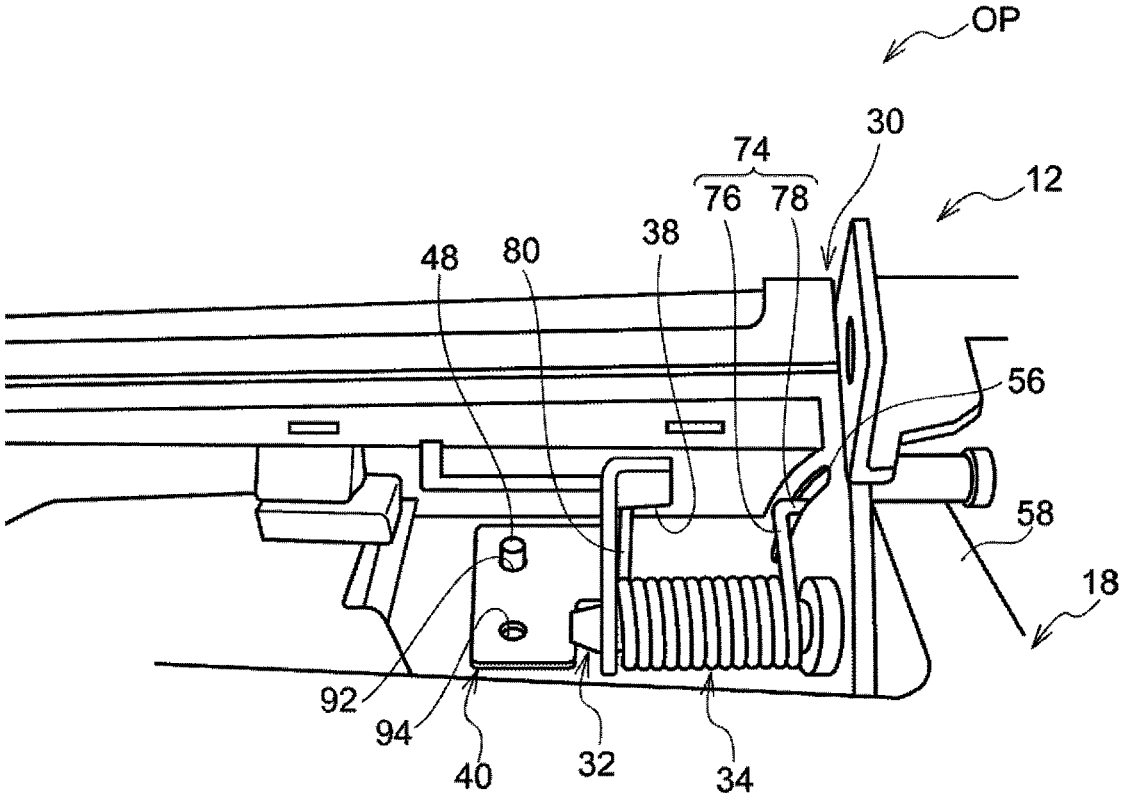
FIG. 18 is a plan view showing the attachment process following FIG. 17.

In this state, as shown in FIG. 18, the plate-like member 18 is brought to the open state OP. At this time, the bracket 40 is positioned at a predetermined position in a state in which the positioning portion 48 is inserted into the positioning hole 92. Hence, the one-end portion 80 of the torsion spring 34 is pressed from above by the reaction-force receiving portion 38 of the bracket 40.

Figure 19:
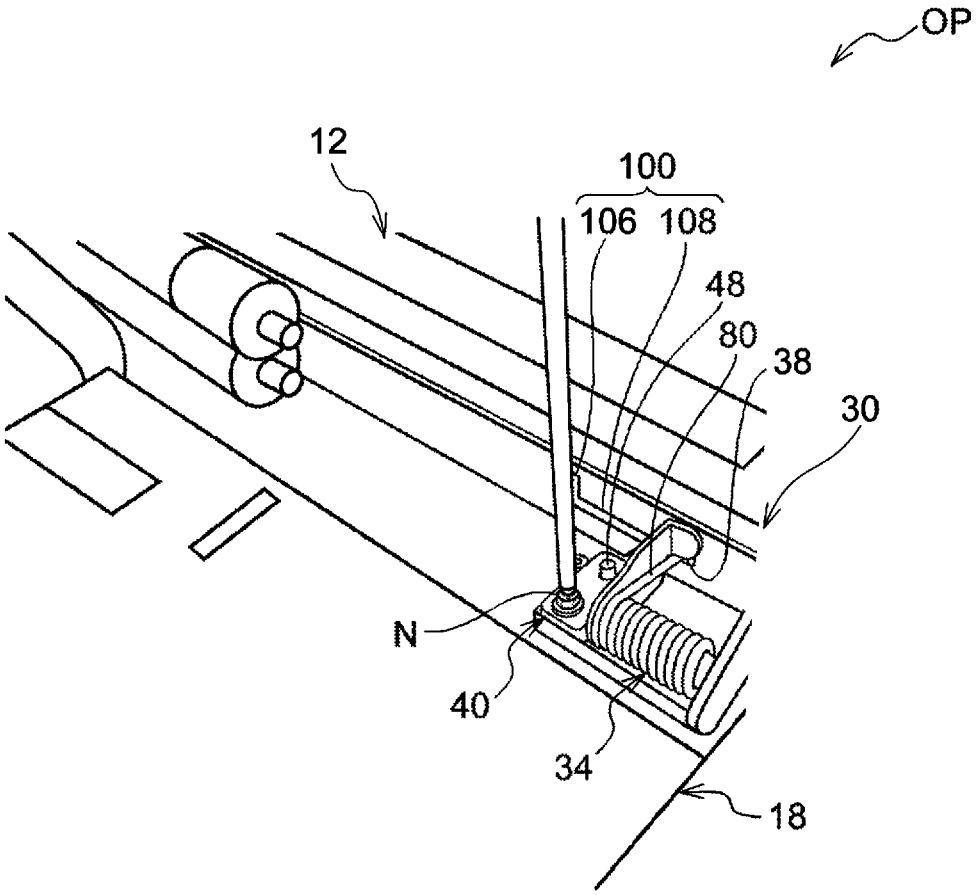
FIG. 19 is a perspective view showing the attachment process following FIG. 18.

In this state, as shown in FIG. 19, a screw N inserted into the screw hole 94 in the bracket 40 is screwed into the screw hole 50 in the frame component 42 with a screwdriver to fix the bracket 40 to the body 12 via the frame component 42.

FIG. 20 shows the positions of the other-side extending portion 78 of the other-end portion 74 of the torsion spring 34 when the plate-like member 18 is opened and closed. FIG. 20 shows an initial load position 200, where the other-side extending portion 78 is located in the closed state CS, and a high-load position 202, where the other-side extending portion 78 is located in the open state OP. FIG. 20 also shows a free position 204, where the other-side extending portion 78 is located when the torsion spring 34 is not inserted into the plate-like member 18 and thus is subjected to no load.

When the plate-like member 18 in the closed state CS is brought to the open state OP, the other-end portion 74 of the torsion spring 34 rotates in the winding direction of the steel wire 70 about the central axis C of the coil portion 72, increasing the spring force that brings the plate-like member 18 to the closed state CS. This spring force serves as the damping force mentioned above and reduces the impact caused when the plate-like member 18 is opened.

Advantage and Effect

The advantages and effects of this exemplary embodiment will be described.

The attachment part 30 according to this exemplary embodiment has the temporarily fixing groove 100 into which the one-end portion 80 of the torsion spring 34 fitted on the shaft part 32 is inserted to temporarily fix the torsion spring 34 to the body 12. The attachment part 30 also has the gap 102, in which, in the closed state CS, the torsion spring 34 can be moved along the shaft part 32 so that the other-end portion 74 of the torsion spring 34 is inserted into the insertion hole 104 in the plate-like member 18. The attachment part 30 also has the bracket 40 that is fixed to the body 12 in the open state OP and presses the other-end portion 74 of the torsion spring 34.

With this configuration, it is possible to insert the other-end portion 74 of the torsion spring 34 into the insertion hole 104 in the plate-like member 18 in the closed state CS, in which the spring force is low. Furthermore, the task of fixing the bracket 40 in the open state OP, in which the spring force is high, can be carried out in a state in which the other-end portion 74 of the torsion spring 34 is temporarily fixed by the temporarily fixing groove 100.

Hence, compared with a case where the torsion spring 34 is fitted when the plate-like member 18, which is opened and closed with respect to the body 12, is in the open state OP, the reaction force is reduced, and thus, ease of fitting is improved.

Furthermore, the temporarily fixing groove 100 has the longitudinal groove 106, into which the one-end portion 80 extending sideward from the torsion spring 34 is inserted, and the lateral groove 108 extending from the end of the longitudinal groove 106, along the shaft part 32. With this configuration, by pressing the one-end portion 80, which extends sideward from the coil portion 72, in the winding direction, the one-end portion 80 can be inserted into the temporarily fixing groove 100 from the longitudinal groove 106.

Hence, compared with a case where the temporarily fixing groove 100 is formed only of a lateral groove, the one-end portion 80 of the torsion spring 34 can be easily inserted therein.

Furthermore, the attachment part 30 has the positioning portion 48 for positioning the bracket 40.

Hence, compared with a case where the bracket 40 is fixed without being positioned, the accuracy of position where the one-end portion 80 of the torsion spring 34 is pressed is high.

The attachment part 30 also has the guide portion 112 that guides the other-end portion 74 of the torsion spring 34, which is moved along the shaft part 32, to the insertion hole 104.

Hence, compared with a case where the other-end portion 74 of the torsion spring 34 is not guided to the insertion hole 104, ease of insertion of the other-end portion 74 is improved.

Furthermore, the guide portion 112 and the bearing 54 for supporting and the shaft part 32 are formed on the frame component 42 to be fixed to the body 12.

Hence, compared with a case where the guide portion 112 and the bearing 54 are formed on different parts, the accuracy of guiding the other-end portion 74 of the torsion spring 34 into the insertion hole 104 is high.

The guide portion 112 has the inclined surface 116, which moves the other-end portion 74 in the direction TH, in which the spring force of the torsion spring 34 increases as the other-end portion 74 is guided from the initial position 118, where the other-end portion 74 is located before the torsion spring 34 is moved, to the insertion position 120, where the other-end portion 74 is inserted into the insertion hole 104.

Hence, compared with a case where the inclined surface 116 is not provided, the other-end portion 74 is inserted into the insertion hole 104, in a state in which the spring force of the torsion spring 34 is high.

Although the bracket 40 is made of a metal plate in this exemplary embodiment, the bracket 40 may be made of a synthetic resin. Furthermore, although the configuration in which the plate-like member 18 is supported on the body 12 in a manner capable of being opened or closed has been described, the configuration is not limited thereto, and, for example, a cover may be supported on the body 12 in a manner capable of being opened or closed.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An attachment structure comprising:

a plate member, the plate member being configured to be in an open state and in a closed state;

a shaft part via which the plate member is rotatably supported on a body;

a torsion spring fitted on the shaft part, the torsion spring generating a damping force when the plate member is brought to the open state;

a frame comprising a temporary fixing groove, the temporary fixing groove extending parallel alongside the shaft part, and into which a one-end portion of the torsion spring fitted on the shaft part is inserted to temporarily fix the torsion spring to the body, such that the one-end portion of torsion spring is slidable in the temporary fixing groove along an axial direction of the shaft part; and a bracket that is fixed to the body in the open state and is configured to press the one-end portion of the torsion spring, wherein the plate member has a gap through which, in the closed state, the torsion spring can be pressed so as to be moved along the temporary fixing groove along the axial direction of the shaft part so that another-end portion of the torsion spring is inserted into an insertion hole in the plate member.

2. The attachment structure according to claim 1, wherein the temporary fixing groove comprises a longitudinal groove into which the one-end portion extending sideward from the torsion spring is inserted, and a lateral groove extending from an end of the longitudinal groove, and parallel the shaft part.

3. The attachment structure according to claim 2, further comprising a positioning portion for positioning the bracket.

4. The attachment structure according to claim 3, further comprising a guide portion that guides the other-end portion of the torsion spring, moved along the shaft part, into the insertion hole.

5. The attachment structure according to claim 4, wherein the guide portion and a bearing for supporting the shaft part are formed on the frame, the frame being fixed to the body.

6. The attachment structure according to claim 3, further comprising an inclined surface between an initial position, where the other-end portion is located before the torsion spring is moved along the shaft part, and an insertion position, where the other-end portion is inserted into the insertion hole, the inclined surface moving the other-end portion in a direction in which the spring force of the torsion spring increases as the other-end portion moves from the initial position toward the insertion position.

7. The attachment structure according to claim 2, further comprising a guide portion that guides the other-end portion of the torsion spring, moved along the shaft part, into the insertion hole.

8. The attachment structure according to claim 7, wherein the guide portion and a bearing for supporting the shaft part are formed on the frame, the frame being fixed to the body.

9. The attachment structure according to claim 2, further comprising an inclined surface between an initial position, where the other-end portion is located before the torsion spring is moved along the shaft part, and an insertion position, where the other-end portion is inserted into the insertion hole, the inclined surface moving the other-end portion in a direction in which the spring force of the torsion spring increases as the other-end portion moves from the initial position toward the insertion position.

10. The attachment structure according to claim 9, wherein the inclined surface and a bearing for supporting the shaft part are formed on the frame, the frame being fixed to the body.

11. The attachment structure according to claim 1, further comprising a positioning portion for positioning the bracket.

12. The attachment structure according to claim 11, further comprising a guide portion that guides the other-end portion of the torsion spring, moved along the shaft part, into the insertion hole.

13. The attachment structure according to claim 12, wherein the guide portion and a bearing for supporting the shaft part are formed on the frame, the frame being fixed to the body.

14. The attachment structure according to claim 11, further comprising an inclined surface between an initial position, where the other-end portion is located before the torsion spring is moved along the shaft part, and an insertion position, where the other-end portion is inserted into the insertion hole, the inclined surface moving the other-end portion in a direction in which the spring force of the torsion spring increases as the other-end portion moves from the initial position toward the insertion position.

15. The attachment structure according to claim 14, wherein the inclined surface and a bearing for supporting the shaft part are formed on the frame, the frame being fixed to the body.

16. The attachment structure according to claim 1, further comprising a guide portion that guides the other-end portion of the torsion spring, moved along the shaft part, into the insertion hole.

17. The attachment structure according to claim 16, wherein the guide portion and a bearing for supporting the shaft part are formed on the frame, the frame being fixed to the body.

18. The attachment structure according to claim 1, further comprising an inclined surface between an initial position, where the other-end portion is located before the torsion spring is moved along the shaft part, and an insertion position, where the other-end portion is inserted into the insertion hole, the inclined surface moving the other-end portion in a direction in which the spring force of the torsion spring increases as the other-end portion moves from the initial position toward the insertion position.

19. The attachment structure according to claim 18, wherein the inclined surface and a bearing for supporting the shaft part are formed on the frame, the frame being fixed to the body.

20. An image forming apparatus comprising the attachment structure according to claim 1, wherein the plate member is a tray configured to supply a medium on which an image is to be formed.

* * * * *